US006256799B1

(12) United States Patent
McGlasson et al.

(10) Patent No.: US 6,256,799 B1
(45) Date of Patent: Jul. 10, 2001

(54) HELMET COVERS

(76) Inventors: Shirley J. McGlasson; Bryan K. McGlasson, both of 9211 S. Prairie View Dr., Highlands Ranch, CO (US) 80126

( * ) Notice: Subject to any disclaimer, the term of this patent is extended or adjusted under 35 U.S.C. 154(b) by 0 days.

(21) Appl. No.: 09/371,590

(22) Filed: Aug. 10, 1999

(51) Int. Cl.[7] ..... A42B 3/00
(52) U.S. Cl. ..... 2/422; 2/411
(58) Field of Search ..... 2/410, 411, 412, 2/422, 424, 425

(56) References Cited

U.S. PATENT DOCUMENTS

| | | | | |
|---|---|---|---|---|
| D. 180,052 | | 4/1957 | Young | D3/13 |
| D. 335,384 | | 5/1993 | Beitscher et al. | D2/250 |
| D. 344,844 | | 3/1994 | Beitscher et al. | D2/869 |
| D. 344,845 | | 3/1994 | Beitscher et al. | D2/869 |
| 3,015,104 | | 1/1962 | Crosson et al. | 2/6 |
| 3,155,981 | * | 11/1964 | McKissick et al. | 2/422 |
| 4,106,124 | | 8/1978 | Green | 2/187 |
| 5,289,591 | * | 3/1994 | Andersen | 2/411 |
| 5,481,759 | * | 1/1996 | Rinaldi | 2/195.1 |
| 5,519,895 | | 5/1996 | Barnes, Jr. | 2/422 |
| 5,638,544 | * | 6/1997 | Sump | 2/6.6 |
| 5,724,681 | | 3/1998 | Sykes | 2/425 |
| 5,887,289 | * | 3/1999 | Theoret | 2/425 |

OTHER PUBLICATIONS

Print–out of home page from Website, EQ Rider: http://www.eqrider.com/home.html.
Print–out of home page from Website, Helmet Helpers from EQ Rider: http://www.eqrider.com/prod00k.html.
Print–out of home page from Website, Helmet Helpers: http:/www.eqrider.com/ski products/index.html.
Print–out of home page from Website, Helmet Helpers: http://www.eqrider.com/ski products/.htm.
Print–out of home page from Website, Helmet Helpers: http://www.eqrider.com/ski products/order.htm.

* cited by examiner

*Primary Examiner*—Michael A. Neas
(74) *Attorney, Agent, or Firm*—Townsend and Townsend and Crew LLP

(57) ABSTRACT

A helmet cover is provided for covering a helmet having a rigid shell with an outer surface, and inner surface and an outer edge. A padding material is also coupled to the inner surface. The cover comprises a flexible cover body that is adapted to be removably disposed about the outer surface of the shell. The flexible body has an outer periphery and an elastic material that is disposed near the outer periphery. Further, the body is shaped that it is adapted to be folded over the outer edge of the shell such that the elastic material is positioned generally adjacent to the inner surface of the shell.

17 Claims, 7 Drawing Sheets

HELMET COVERS

BACKGROUND OF THE INVENTION

This invention relates generally to the field of covers, and in particular to helmet covers that may be removably placed over a wide variety of protective helmets.

Helmets have long provided protection to their wearers. Presently, helmets are used as protective equipment when performing a wide variety of activities. For example, helmets are often worn during various sporting events, such as cycling, skiing, kayaking, skating, mountain climbing, and the like. Helmets are also worn in connection with various occupations, such as construction, mining, and the like.

Recently, many have become concerned with providing protection to children and young adults during various activities. For example, many states now require a child to wear a protective helmet when riding a cycle, when being towed behind a bicycle, when skating, and the like. Children's helmets have also been produced for various winter activities, such as skiing and snowboarding.

Although such protective helmets can provide a significant amount of protection to the wearer, many (and particularly children and young adults) are reluctant to wear such helmets. One reason for this reluctance is the appearance of the helmets. Because of current fashions, many young people feel embarrassed when wearing a protective helmet.

Hence, the invention is related to covers that may be coupled to protective helmets to make them more aesthetically pleasing and to encourage their use. The invention also relates to techniques for coupling such covers to currently available helmets in an easy an economic manner.

SUMMARY OF THE INVENTION

The invention provides various helmet covers and methods for their use. In one embodiment, a cover is provided for use with a helmet that comprises a rigid shell having an outer surface, an inner surface and an outer edge, and a padding material coupled to the inner surface. The cover comprises a flexible cover body that may be removably disposed about the outer surface of the shell. The flexible body has an outer periphery and an elastic material disposed at or near the outer periphery. Further, the body is shaped so that it is may be folded over the outer edge of the shell such that the elastic material is positioned generally adjacent the inner surface of the shell. In this way, a cover may easily be retrofitted to a protective helmet simply by placing the cover over the outer shell and wrapping the elastic material over the edge of the shell until it is adjacent the inner surface. Once positioned in this manner, the elastic material helps to keep the cover in place. To remove the cover, the elastic material is simply stretched and unwrapped from the shell.

In one aspect, the outer periphery of the flexible body is shaped to correspond with the shape of the outer edge of the shell to facilitate coupling of the cover to the shell. In another aspect, the helmet includes a rounded section to cover an ear of the wearer. Further, an elastic strip coupled to spaced apart locations on the cover body to permit the elastic strip to be placed about the rounded section of the shell. In this way, the elastic strip further assists in holding the cover to the helmet.

In one particular aspect, at least one peripheral item is coupled to the cover body to make the cover more creative and aesthetically appealing. Examples of peripheral items that may be used include items such as ears, eyes, noses, horns, hair, tails, antlers, hats, caps, claws, legs, arms, hands, fins, whiskers, braids, teeth, antennae, logos, designs, and the like. Conveniently, a variety of materials may be employed to construct the flexible body including fabrics, such as cloth, felt, mesh, as well as other materials such as vinyl, leather, and the like.

The invention further provides an exemplary method for covering a helmet. According to the method, a helmet cover is provided that comprises a rigid shell having an outer surface, an inner surface and an outer edge, and a padding material coupled to the inner surface. A cover is also provided that comprises a flexible body having an outer periphery and an elastic material disposed near or at the outer periphery. The cover is placed about the shell and is folded over the outer edge of the shell so that the elastic material is positioned generally adjacent the inner surface of the shell. The cover may further be manipulated so that the flexible body conforms generally to the shape of the shell. Hence, the cover may conveniently be placed about the helmet simply by stretching the cover and placing it about the shell, with the elastic material being folded over the edge of the shell.

In one aspect, the outer periphery of the flexible body is shaped to correspond with the shape of the outer edge of the shell. In this way, the cover may be folded over the outer edge such that the elastic material is disposed near the edge so that the cover will not interfere with the interface between the padding material and the wearer's head. In another aspect of the method, the helmet includes a rounded section to cover an ear, and the cover includes an elastic strip coupled to spaced apart locations on the cover body. With such a configuration, the elastic strip is placed about the rounded section of the shell to assist in holding the cover to the helmet.

In another aspect, at least one peripheral item may be coupled to the cover body. The peripheral item may be integrally formed with the flexible body, or may be configured to be attached by the wearer, using a type of fastener, such as a snap, a hook and loop fastener material, and the like. Examples of such peripheral items include ears, eyes, noses, horns, hair, tails, antlers, hats, caps, claws, legs, arms, hands, fins, whiskers, braids, teeth, antennae, logos, designs, and the like.

DESCRIPTION OF THE SPECIFIC EMBODIMENTS

Figure 1:
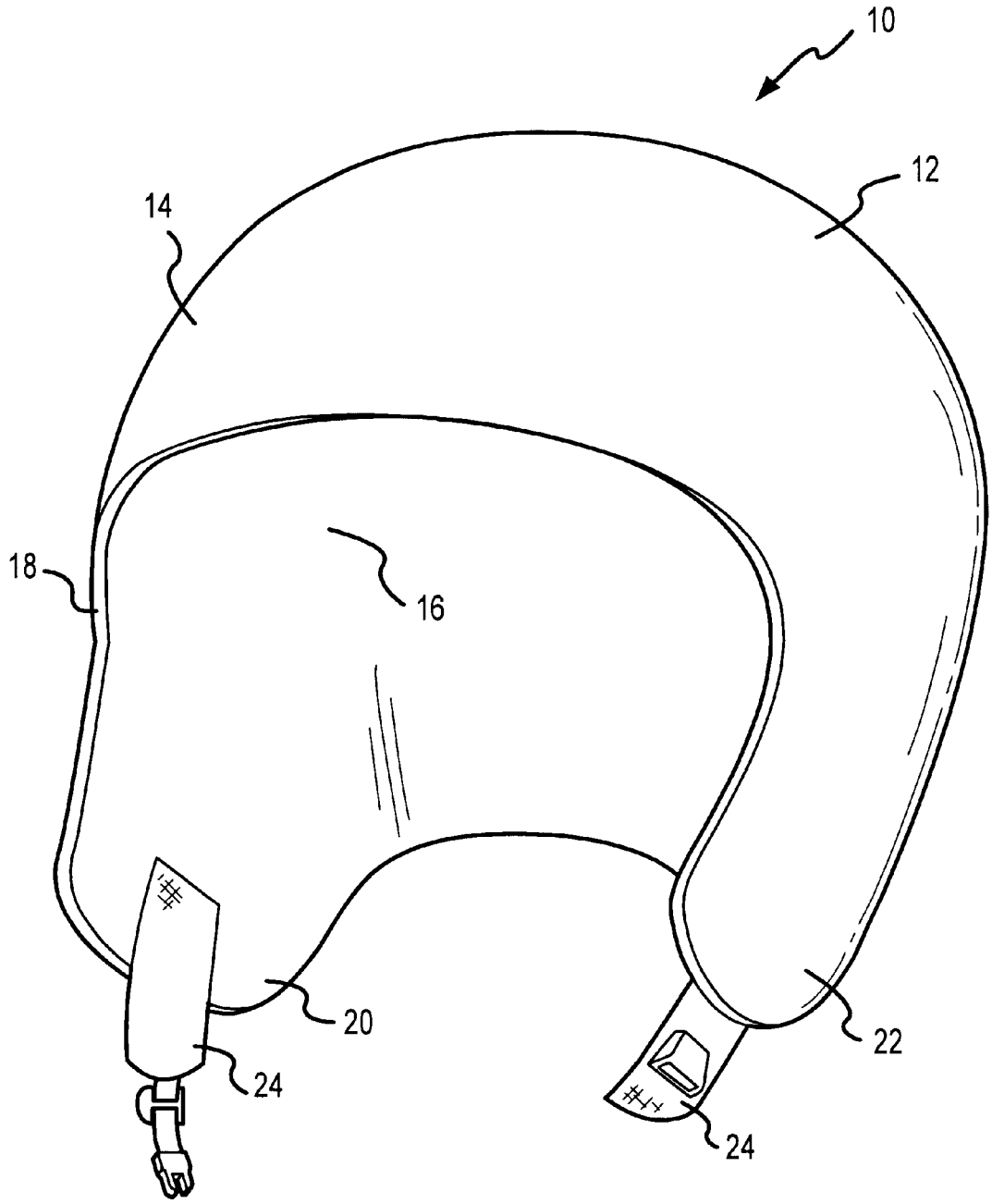
FIG. 1 is a top perspective view of one embodiment of a shell of a protective helmet.

The invention provides various covers that may be removably attached to a wide variety of protective helmets. The helmets that may be used with the invention typically include a rigid exterior or shell that covers various types and arrangements of padding. Examples of helmets that may be used with the invention include cycling helmets, skiing helmets, skating helmets, hockey helmets, football helmets, baseball and softball helmets, construction helmets, and the like.

The helmet covers may be constructed of a flexible material that may be placed about the exterior of the helmet. The covers may be manipulated so that they generally conform to the shape of the helmet. However, in some cases, the covers may be constructed to have a different overall shape than the helmet. Further, in some cases, portions of the covers may be rigid so that they project from the helmet in a desired shape or pattern.

The covers may include an outer periphery that is flexible so that it may be wrapped about the edge of the helmet to hold the cover to the helmet. An elastic material may also be coupled to the outer periphery (or slightly inset from the outer periphery) of the cover so that it will be placed within the interior of the helmet when the cover is folded about the edge of the helmet. Use of the elastic material is advantageous in that it helps hold the cover to the helmet. In some cases, the padding material of the helmet may not fully extend to the outer edge of the shell and/or may not be secured to the shell at the outer edge. As such, the covers may be folded about the outer edge and the elastic material placed adjacent an inner surface of the shell (in some cases being positioned between the shell and the padding material). Conveniently, the shape of the cover may be configured so that the elastic overlaps the edge of the shell by a distance in the range from about 5 mm to about 3 cm. With some helmets, the padding material may extend to the outer edge, such as with many bicycle helmets. In such a case, the cover may be wrapped about the edge and placed adjacent the padding material.

Optionally, one or more elastic strips may be secured to the outer periphery of the cover at spaced apart locations. Such elastic strips may then be placed over projecting features on the outer edge of the helmet. For example, with some helmets, a curved edge may be provided where the helmet covers the ears. The elastic strips may be placed over the curved edges to further assist in holding the cover to the helmet.

A variety of materials may be employed to construct the cover body. For example, a wide variety of fabrics may be used including cloth, felt, polyester, nylon, mesh, LYCRA fabrics, and the like. Other materials that may be used include vinyl, leather, plastics, and the like.

To enhance the appearance of the helmet covers, a wide assortment of peripheral or accessory items may be coupled to the cover bodies. For example, such items may include ears, eyes, noses, horns, hair, tails, antlers, hats, caps, claws, legs, arms, hands, fins, whiskers, braids, teeth, antennae, logos, designs, and the like. These items may be fixedly or removably attached to the cover bodies. For example, the peripheral items may be sewn, glued, or the like to the cover bodies at the time of manufacture. Alternatively, various items may be provided that may be attached by the user. For example, the cover bodies may be configured so that the wearer may simply attach various items. For instance, the cover body may be constructed of felt, and various items provided that have a hook and loop fastener material, such as a VELCRO fastener material, to permit the items to be coupled to the cover bodies. Other attachment schemes, include the use of snaps, hooks, strings, and the like.

Referring now to FIG. 1, one embodiment of a helmet 10 that may be used with the invention will be described. Helmet 10 comprises a rigid shell 12 having an outer surface 14, an inner surface 16 and an outer edge 18. Coupled to inner surface 16 is a padding material which is not shown for convenience of illustration. The padding material may be a continuous layer of padding or discrete elements that are secured to shell 12 as is known in the art.

Helmet 10 further includes two ear regions 20 and 22 that are configured to be placed over the wearer's ears when helmet 10 is worn. Extending from ear regions 20 and 22 is a chin strap system 24 that is employed to be placed around the wearer's chin to secure helmet 10 to the wearer's head.

Figure 2:
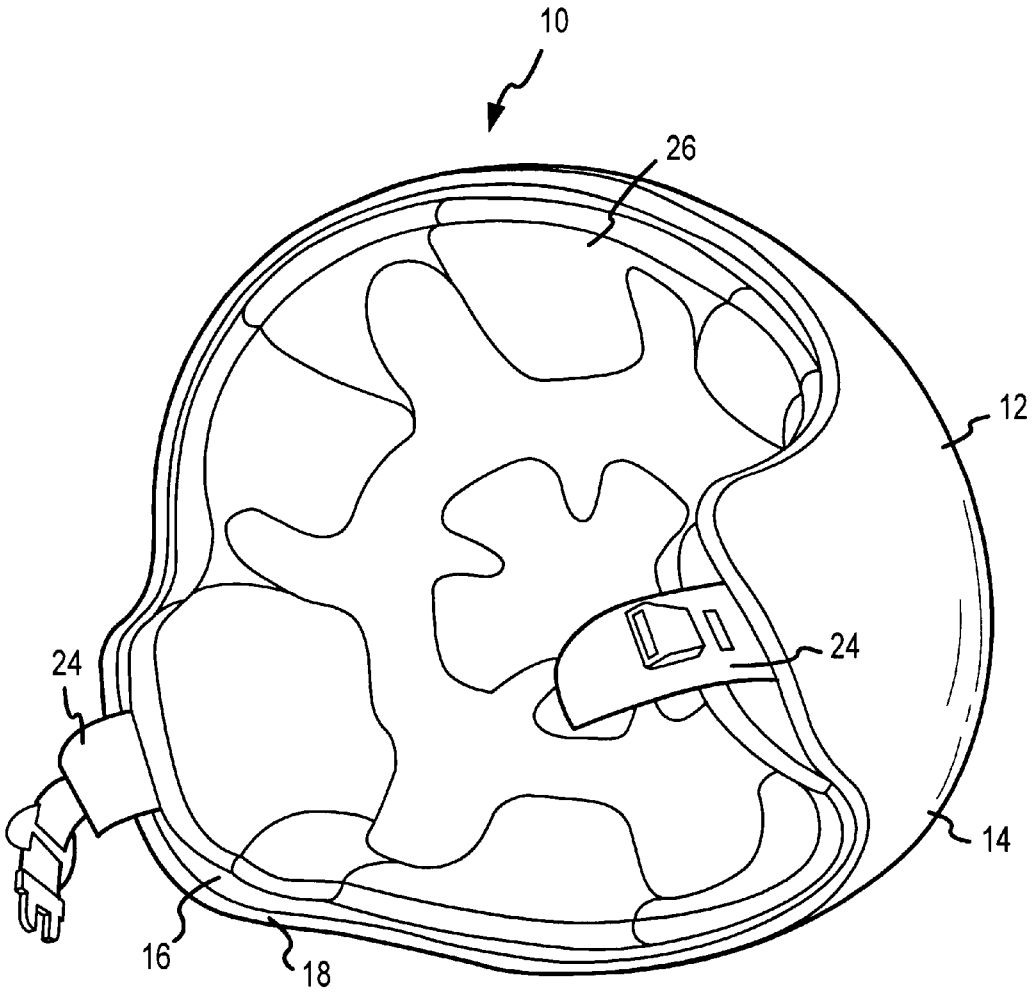
FIG. 2 is a bottom perspective view of the helmet of FIG. 1 with a padding material coupled to the shell.

Referring now to FIG. 2, helmet 10 is shown with a padding material 26 coupled to inner surface 16 of shell 12. As shown, padding material 26 extends approximately to outer edge 18. Padding material 26 is coupled to inner surface 16 such that padding material 26 may be separated from inner surface 16 near edge 18. In this way, strap system 24 may be coupled to inner surface 16 while being disposed between shell 12 and padding material 26 as shown. As described in greater detail hereinafter, such a feature also permits a helmet cover to be wrapped about edge 16, with at least a portion of the helmet cover being positioned between shell 12 and padding material 26. In some cases, padding material 26 may not fully extend to outer edge 18 and provides a convenient ledge over which the helmet cover may be disposed as described hereinafter.

Figure 3:
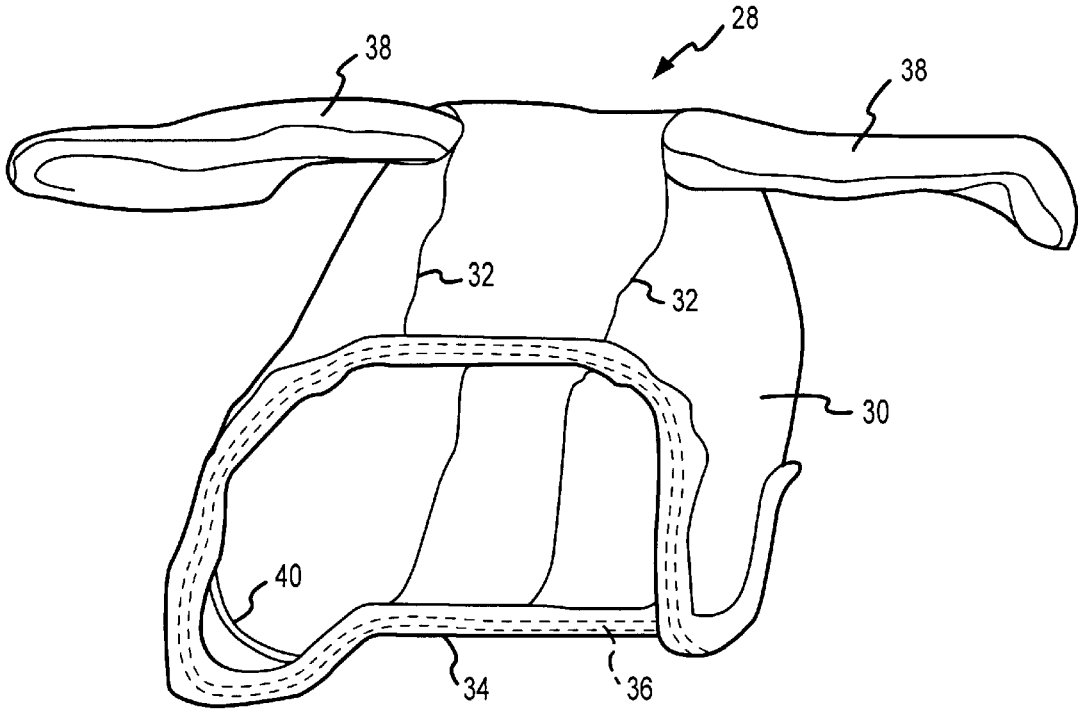
FIG. 3 is a perspective view of one embodiment of a helmet cover according to the invention.

Referring now to FIG. 3, one embodiment of a helmet cover 28 will be described. Helmet cover 28 comprises a flexible cover body 30 that may be constructed of any flexible material, such as a fabric. Conveniently, the fabric is sewn together at multiple seam zones 32 to form the desired shape. However, it will be appreciated that cover body 30 may be made of a unitary construction. Cover body 30 has an outer periphery 34 that has a shape that generally corresponds to the outer edge of the helmet about which cover 28 is to be placed. Placed near or at outer periphery 34 is an elastic material 36. As described hereinafter, elastic material 36 may be employed to assist in holding helmet 28 to a helmet. Elastic material 36 may be included at outer periphery 34 or slightly inset from outer periphery 34 to permit outer periphery 34 to form a fringe about the helmet. Elastic material 36 may be constructed from a variety of materials including elastic fabric strips, rubber bands, and the like. Use of an elastic fabric is advantageous in that it may easily be sewn to cover body 30.

Coupled to cover body 30 are a pair of ears 38. Conveniently, ears 38 may be sewn to cover body 30 and may be constructed of the same fabric. In this way, ears 38 will be flexible and will flap in the wind when cover 28 is worn on a helmet.

Helmet cover 28 may optionally include an elastic strip 40 that is coupled to spaced apart locations near outer periphery 34. Preferably, each elastic strip 40 will be positioned so that it may be placed about the ear covers on the helmet as described hereinafter. In this way, strips 40 help hold cover 28 to the helmet. Elastic strips 40 may conveniently be constructed of an elastic fabric. In one alternative embodiment, strips 40 may simply be constructed of a non-elastic fabric.

Figure 4:
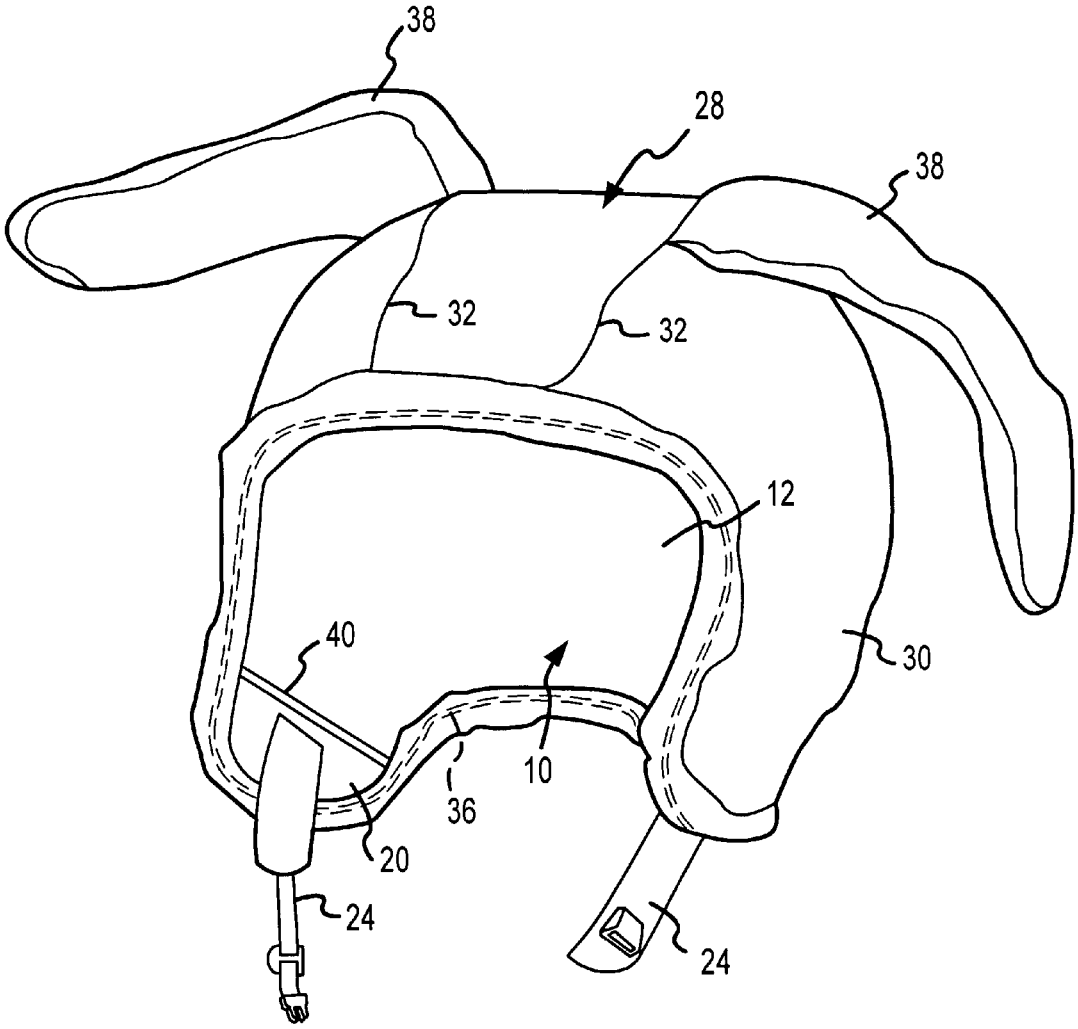
FIG. 4 illustrates the helmet cover of FIG. 3 when coupled to the helmet shell of FIG. 1.
Figure 5:
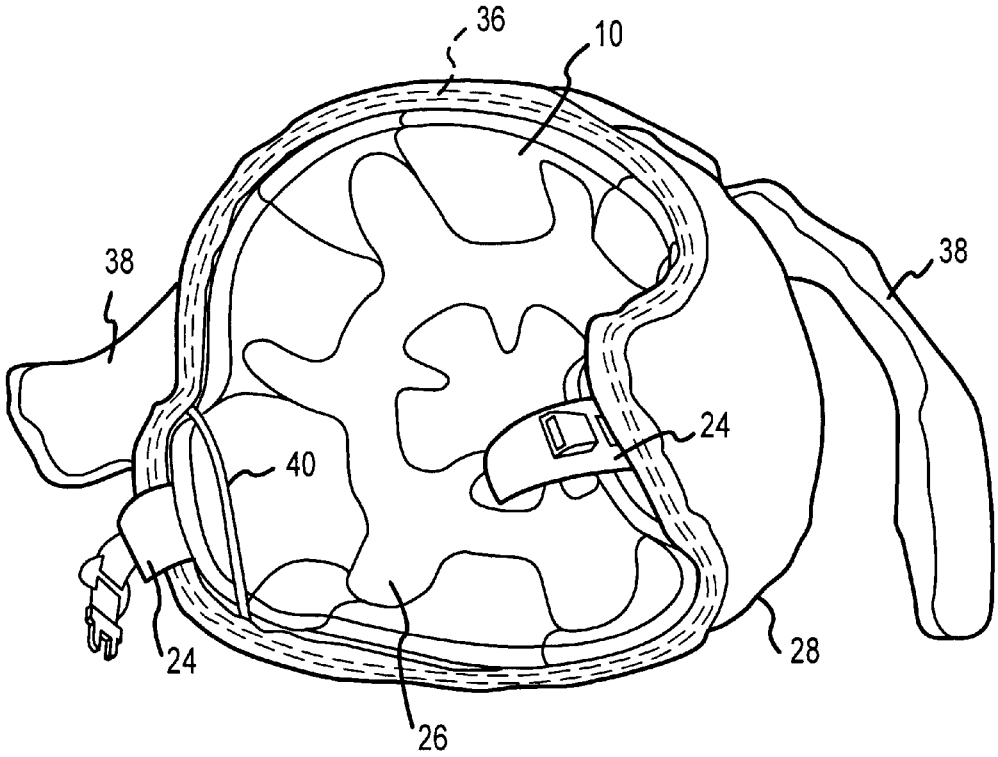
FIG. 5 illustrates the helmet cover of FIG. 3 when coupled to the helmet of FIG. 2.

Referring now to FIG. 4, helmet cover 28 is shown coupled to helmet 10. As shown, helmet cover 28 conforms generally to the shape of shell 12. Cover body 30 may be constructed to be either tight fitting or loosely fitting about shell 12. As also shown in FIG. 5, strips 40 are disposed across ear regions 20 (as well as padding material 26) and assist in holding cover 28 to helmet 10. Further, outer periphery 34 of cover body 30 is wrapped around outer edge 18 of shell 12. In this way, elastic material 36 is placed adjacent inner surface 16 near outer edge 18. In this manner, elastic material 36 assists in holding helmet cover 28 to helmet 10. At some regions, padding material 26 may be separated from shell 12 (such as at ear regions 20). In such a case, cover body 30 may be inserted between shell 12 and padding material 26. In other cases, padding material 26 may be inset from outer edge 18. In such a case, elastic material 36 may simply be wrapped about outer edge 18 and placed adjacent inner surface 16. In other embodiments, it may be possible to fold cover body 30 about outer edge 18, with elastic material 36 being placed adjacent padding material 26. This may be particularly useful with helmets where padding material 26 extends completely to outer edge 18.

Hence, helmet cover 28 may conveniently be disposed about helmet 10 simply by placing helmet cover 28 over shell 12 and placing chin strap system 24 through elastic strips 40. Cover body 30 is then manipulated to wrap elastic material 36 about outer edge 18 until cover 28 is firmly secured about helmet 10. To replace helmet cover 28, elastic strips 40 are simply stretched over chin strap system 24 and cover body 30 is pulled from shell 12.

It will be appreciated that a variety of peripheral items or attachments may be coupled to a flexible cover body to form a wide assortment of helmet covers. Illustrative examples of such helmet covers are presented in FIGS. 6–19, it being appreciated that the invention is not intended to be limited solely to these depictions.

Figure 6:
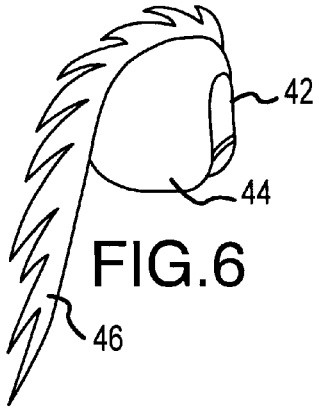
FIGS. 6–19 illustrate various alternative embodiments of helmet covers according to the invention.
Figure 7:
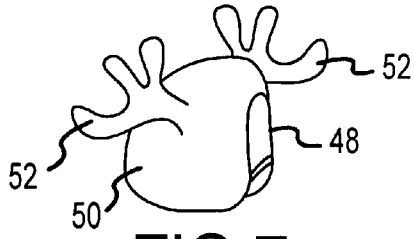
Figure 8:
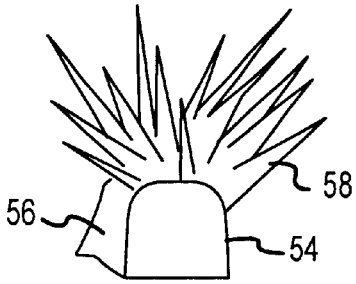

FIG. 6 illustrates a helmet cover 42 comprising a cover body 44 and a dinosaur tail 46 coupled to cover body 44. FIG. 7 illustrates a helmet cover 48 comprising a cover body 50 and a pair of antlers 52 coupled to cover body 50. FIG. 8 illustrates a helmet cover 54 that comprises a cover body 56 and synthetic hair 58 coupled to cover body 56.

Figure 9:
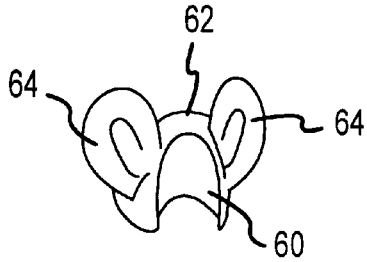
Figure 10:
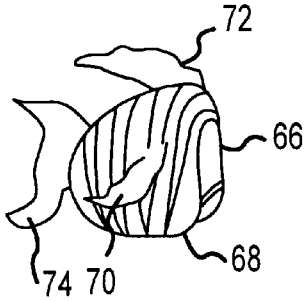
Figure 11:
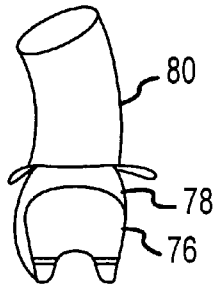
Figure 12:
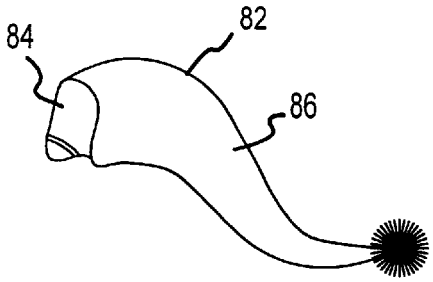

FIG. 9 illustrates a helmet cover 60 comprising a cover body 62 and a pair of mouse ears 64 coupled to cover body 62. In FIG. 10, a helmet cover 66 is shown and comprises a cover body 68 in the form of a fish body. A pair of fins 70 and 72 are coupled to cover body 68 along with a tail 74. FIG. 11 illustrates one embodiment of a helmet cover 76 that comprises a cover body 78. An elongate top hat 80 is coupled to cover body 78. Shown in FIG. 12 is a helmet cover 82 that comprises a cover body 84. Attached to cover body 84 is a stocking hat 86.

Figure 13:
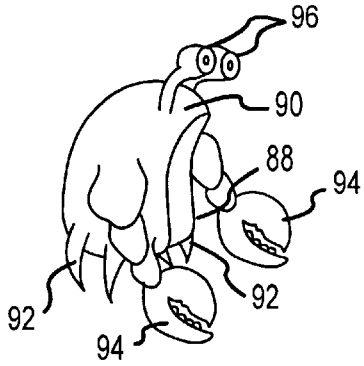

FIG. 13 illustrates a helmet cover 88 that comprises a cover body 90 that is in the shape of a crab's body. Coupled to cover body 90 are a plurality of legs 92 and a pair of pinchers 94. Also coupled to cover body 92 are a pair of eyes 96.

Figure 14:
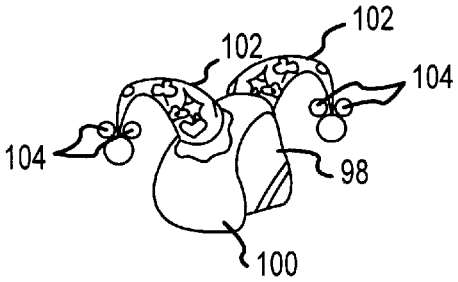

FIG. 14 illustrates a helmet cover 98 that is in the form of a joker's hat. Helmet cover 98 comprises a cover body 100 and a pair of flexible extensions 102 that extend from cover body 100. Conveniently, bells 104 may be coupled to extensions 102.

Figure 15:
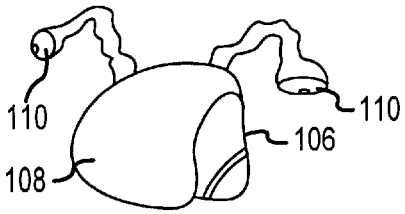
Figure 16:
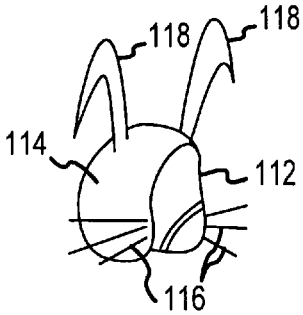

FIG. 15 illustrates a helmet cover 106 that comprises a cover body 108. A pair of alien eyes 110 are coupled to cover body 108. Shown in FIG. 16 is a helmet cover 112 that has the appearance of a rabbit's head. Helmet cover 112 comprises a cover body 114 to which are coupled a plurality of whiskers 116. A pair of ears 118 are also coupled to cover body 114.

Figure 17:
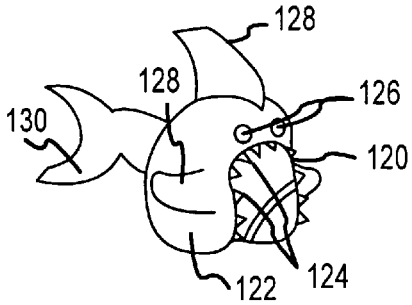

FIG. 17 illustrates a helmet cover 120 that is in the form of a shark. Helmet cover 120 comprises a cover body 122 to which are coupled a plurality of teeth 124 and a pair of eyes 126. Also coupled to cover body 122 are a pair of fins 128 and a tail 130.

Figure 18:
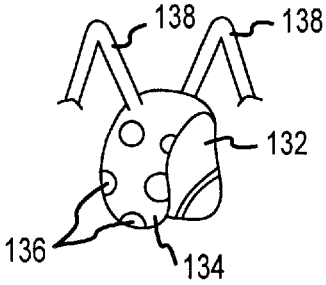

FIG. 18 illustrates a helmet cover 132 that comprises a cover body 134. A plurality of dots 136 are coupled to cover body 134 along with antennae 138. In this way, helmet cover 132 has the appearance of a lady bug.

Figure 19:
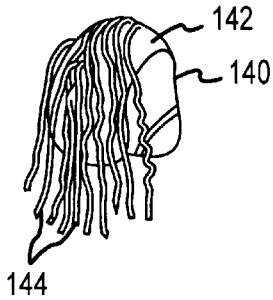

FIG. 19 illustrates a helmet cover 140 that comprises a cover body 142. Synthetic locks of hair 144 are coupled to cover body 142.

Each of the helmet covers illustrated in FIGS. 6–19 may conveniently include an elastic material that is disposed at or near the outer periphery similar to helmet cover 28. Optionally, ear straps may also be provided to assist in coupling the helmet covers about the ear protectors on the helmet in a manner similar to that previously described in connection with helmet cover 28.

The invention has now been described in detail for purposes of clarity of understanding. However, it will be appreciated that certain changes and modifications may be practiced within the scope of the appended claims.

What is claimed is:

1. A cover that is adapted to be placed onto a helmet comprising a rigid shell having an outer surface, an inner surface and an outer edge, and a padding material coupled to the inner surface, the cover comprising:

a flexible cover body that is adapted to be removably disposed about the outer surface of the shell, wherein the flexible body has an outer periphery and an elastic material disposed near the outer periphery, wherein the body is shaped so that it is adapted to be folded over the outer edge of the shell such that the elastic material is positioned generally adjacent the inner surface of the shell; and wherein the helmet includes a rounded section to cover an ear, and further comprising an elastic strip coupled to spaced apart locations on the cover body, wherein the elastic strip is adapted to be placed about the rounded section of the shell.

2. A cover as in claim 1, wherein the outer periphery of the flexible body is shaped to correspond with the shape of the outer edge of the shell.

3. A cover as in claim 1, further comprising at least one peripheral item coupled to the cover body.

4. A cover as in claim 3, wherein the peripheral item is selected from a group of items consisting of ears, eyes, noses, horns, hair, tails, antlers, hats, caps, claws, legs, arms, hands, fins, whiskers, braids, teeth, antennae, logos, and designs.

5. A cover as in claim 1, wherein the cover body comprises a fabric.

6. A helmet system, comprising:

a helmet comprising a rigid shell having an outer surface, an inner surface and an outer edge, and a padding material coupled to the inner surface;

a cover removably disposed about the outer surface of the shell, the cover comprising a flexible body having an outer periphery and an elastic material disposed near the outer periphery, wherein the body is folded over the outer edge of the shell so that the elastic material is positioned generally adjacent the inner surface of the shell; and wherein the shell includes a rounded section to cover an ear, and further comprising an elastic strip coupled to spaced apart locations on the cover body, wherein the elastic strip is placed about the rounded section of the shell.

7. A system as in claim 6, wherein the outer periphery of the flexible body is shaped to correspond with the shape of the outer edge of the shell.

8. A system as in claim 6, further comprising at least one peripheral item coupled to the cover body.

9. A system as in claim 8, wherein the peripheral item is selected from a group of items consisting of ears, eyes, noses, horns, hair, tails, antlers, hats, caps, claws, legs, arms, hands, fins, whiskers, braids, teeth, antennae, logos, and designs.

10. A system as in claim 6, wherein the cover body comprises a fabric that conforms generally to the shape of the shell.

11. A method for covering a helmet, the method comprising:

providing a helmet comprising a rigid shell having an outer surface, an inner surface and an outer edge, and a padding material coupled to the inner surface;

providing a cover comprising a flexible body having an outer periphery and an elastic material disposed near the outer periphery; and placing the cover about the shell, with the cover being folded over the outer edge of the shell so that the elastic material is positioned generally adjacent the inner surface of the shell;

wherein the helmet includes a rounded section to cover an ear, and wherein the cover includes an elastic strip coupled to spaced apart locations on the cover body, and further comprising placing the elastic strip about the rounded section of the shell.

12. A method as in claim 11, wherein the outer periphery of the flexible body is shaped to correspond with the shape of the outer edge of the shell, and wherein the placing step comprising folding the cover over the outer edge such that the elastic material is disposed near the edge.

13. A method as in claim 11, further comprising providing at least one peripheral item that is coupled to the cover body.

14. A method as in claim 13, wherein the peripheral item is selected from a group of items consisting of ears, eyes, noses, horns, hair, tails, antlers, hats, caps, claws, legs, arms, hands, fins, whiskers, braids, teeth, antennae, logos, designs.

15. A method as in claim 11, wherein the cover body comprises a fabric and further comprising manipulating the cover body such that it generally conforms to the shape of the shell.

16. A helmet system, comprising:

a helmet comprising a rigid shell having an outer surface, an inner surface and an outer edge, and a padding material coupled to the inner surface;

a cover removably disposed about the outer surface of the shell, the cover comprising a flexible body having an outer periphery and an elastic material disposed near the outer periphery, wherein the body is folded over the outer edge of the shell so that the elastic material is positioned generally adjacent the inner surface of the shell and at a location that is spaced apart from the outer edge of the helmet.

17. A method for covering a helmet, the method comprising:

providing a helmet comprising a rigid shell having an outer surface, an inner surface and an outer edge, and a padding material coupled to the inner surface;

providing a cover comprising a flexible body having an outer periphery and an elastic material disposed near the outer periphery; and placing the cover about the shell, with the cover being folded over the outer edge of the shell so that the elastic material is positioned generally adjacent the inner surface of the shell at a location spaced apart from the outer edge of the helmet.

* * * * *